US008746263B2

(12) United States Patent
Lee

(10) Patent No.: US 8,746,263 B2
(45) Date of Patent: Jun. 10, 2014

(54) PARASOL

(76) Inventor: Boo Il Lee, Busan-si (KR)

( * ) Notice: Subject to any disclaimer, the term of this patent is extended or adjusted under 35 U.S.C. 154(b) by 0 days.

(21) Appl. No.: 13/634,234

(22) PCT Filed: Mar. 10, 2011

(86) PCT No.: PCT/KR2011/001662

§ 371 (c)(1),
(2), (4) Date: Sep. 11, 2012

(87) PCT Pub. No.: WO2011/112012

PCT Pub. Date: Sep. 15, 2011

(65) Prior Publication Data

US 2013/0000686 A1 Jan. 3, 2013

(30) Foreign Application Priority Data

Mar. 11, 2010 (KR) ..... 10-2010-0021988

(51) Int. Cl.

| | |
|---|---|
| ***A45B 25/16*** | (2006.01) |
| ***A45B 19/10*** | (2006.01) |
| ***A45B 25/06*** | (2006.01) |
| *A45B 25/08* | (2006.01) |

(52) U.S. Cl.

CPC ..... *A65B 25/02* (2013.01); *A45B 19/10* (2013.01); *A45B 25/06* (2013.01)

USPC ..... 135/20.3; 135/40

(58) Field of Classification Search

USPC ..... 135/20.3, 37, 38, 40

See application file for complete search history.

(56) References Cited

U.S. PATENT DOCUMENTS

| | | | | | |
|---|---|---|---|---|---|
| 362,888 | A | * | 5/1887 | Glenn | 135/40 |
| 1,037,060 | A | * | 8/1912 | Schonert | 135/39 |
| 2,047,712 | A | * | 7/1936 | Siers | 135/37 |
| 2,068,067 | A | * | 1/1937 | Okun | 135/25.31 |
| 2,833,297 | A | * | 5/1958 | Tibony | 135/25.31 |
| 5,088,512 | A | * | 2/1992 | Chou et al. | 135/24 |
| 5,816,276 | A | * | 10/1998 | Seidel et al. | 135/24 |
| 2003/0005951 | A1 | | 1/2003 | Wu | |

FOREIGN PATENT DOCUMENTS

| | | |
|---|---|---|
| JP | 2001-178516 | 7/2001 |
| JP | 2009-165603 | 7/2009 |
| KR | 10-2007-0116782 | 12/2007 |
| KR | 20-0437932 | 1/2008 |

OTHER PUBLICATIONS

International Search Report for PCT/KR2011/001662 Mailed on Dec. 21, 2011.

* cited by examiner

*Primary Examiner* — Noah Chandler Hawk

(74) *Attorney, Agent, or Firm* — Revolution IP, PLLC

(57) ABSTRACT

The present invention relates to a parasol which provides shade from the sun to protect the body of a user, particularly, the face of the user, and which solves the problem of having to manually fold or unfold the outer ribs of a parasol rib assembly one by one, thereby ensuring convenience of use.

5 Claims, 13 Drawing Sheets

PARASOL

RELATED APPLICATIONS

This application is a 371 application of International Application No. PCT/KR2011/001662, filed Mar. 10, 2011, which in turn claims priority from Korean Patent Application No. 10-2010-0021988, filed Mar. 11, 2010, each of which is incorporated herein by reference in its entirety.

TECHNICAL FIELD

The present invention relates to a parasol which is generally used to protect a face of a users body from sunshine, and particularly to a parasol which makes it possible to overcome the inconveniences that a user is needed to manually unfold and fold with hands the outer ribs of a parasol rib assembly while ensuring convenience when in use.

BACKGROUND ART

An ordinary parasol which is used to protect a face of a users body from sunshine comprises a parasol shank body formed of a lower shank part having a handle engaged at its lower end portion, and an upper shank part which flexibly slides from the lower shank part. A parasol rib assembly to which a parasol cloth is engaged is engaged to the parasol shank body.

Here the parasol rib assembly is characterized in that a plurality of inner ribs are rotatably engaged in a radial shape to a fixing member fixed at an upper end portion of the upper shank part, and a plurality of outer ribs are pinned to pin engaging parts formed just above the other end portion of each inner rib and are rotatable.

The outer ribs are figured in such a way that they are externally exposed when folded. At an end portion of each inner rib is formed a support part extended from each pin engaging part, so the support parts of the lower sides of the inner ribs can support the outer ribs in a state that the parasol is unfolded.

Both ends of each support rib are rotatably engaged to an ascending and descending member in a radial shape, the ascending and descending member ascending and descending along an intermediate portion of each inner rib and the upper shank part of a parasol shank body, and the ascending and descending member are fixed by means of an engaging protrusion elastically supported by a spring engaged at the upper shank body in a raised up state for the purpose of unfolding the parasol.

The thusly constructed conventional parasol is used for protecting a face of a user's body from sunshine; however the parasol is unfolded in such a way that a user pushes up an ascending and descending member while holding it with a hand in a state that the outer ribs of the parasol rib assembly are uniformly unfolded and arranged with hands in a state that the parasol shank body is extended, and the user is needed to manually fold the outer ribs with the hands when folding and storing the parasol.

The above described construction makes it hard to ensure a prompt operation owing to the inconvenience that the outer ribs are manually unfolded and folded. Most of parasol users wish to purchase a new parasol which does not have the problems encountered in the conventional parasol.

DISCLOSURE OF INVENTION

Accordingly, the inventor of the present invention has invented in an attempt to improve the whole problems of a conventional parasol which occur in terms of the operations of the outer ribs of the parasol rib assembly. It is an object of the present invention to provide a parasol which is characterized in that a parasol rib assembly is automatically unfolded when moving upward an ascending and descending member unless a user manually unfolds and folds with hands the outer ribs of a parasol rib assembly, and when the ascending and descending member descends downward, the parasol rib assembly is automatically folded for thereby ensuring good convenience when in use.

To achieve the above objects, first of all there is provided a parasol which includes a parasol shank body formed of a lower shank part to which a handle is engaged to its lower side, and an upper shank part which flexibly slides long the lower shank part, and engaging shoulders are formed at an upper side of the lower shank part and a lower side of the upper shank part, and engaging holes are formed above the engaging shoulders and overlap as the parasol shank body prolongs, and the parasol shank body is fixed in a prolonged state with the aid of the engaging protrusion elastically supported by means of a spring installed at an inner upper side of the engaging shoulder of the lower shank part, and a plurality of inner ribs are rotatably engaged in a radial shape to the fixing member fixed at the top of the upper shank part, and the other end of each inner rib is pinned at a pin engaging part formed at the outer rib, and the outer rib is configured in such a way that the outer rib is exposed to the outside in a folded state, and at an inner end of the outer rib is formed a support part which is prolonged from the pin engaging part, and the support part can be supported on the lower side of the inner rib in an unfolded state of the outer ribs, and both ends of each support rib of the parasol rib assembly are rotatably engaged in a radial shape to the ascending and descending member which ascends and descends along the intermediate portion of the inner rib and the upper shank part of the parasol shank body, which comprises a second ascending and descending member which slides along an upper shank part at a lower side of the ascending and descending member and is inserted into the handle when the parasol shank body is contracted in a folded state of the parasol rib assembly; and an inner pulling piece and an outer pulling piece interconnected by means of ring parts are rotatably engaged to the second ascending and descending member and the support part formed at the inner side of the outer rib; and at the second ascending and descending member are installed an upper engaging part and a lower engaging part at an angle interval of 90° in a circumferential direction which are pressurized toward the upper shank part by means of an elastic force of the spring; and with an engaging shoulder being formed at its lower side, the upper engaging part is inserted into the fixing hole formed at the top of the upper shank part of the parasol shank body in a state that the parasol rib assembly is unfolded, and with an engaging shoulder being formed at its upper side, the lower engaging part is inserted into the fixing hole formed at a lower side of the upper shank part in a state that the parasol rib assembly is folded.

Second of all, the support rib and said inner rib are formed in upside down U-shapes and are configured to face each other, and when the parasol rib assembly is folded, the inner pulling piece and the outer puling piece do not escape as the portion just below the connection portion interconnected by means of the ring parts are inserted in the support rib and the inner rib by means of the facing escape prevention pins at the lower side of the engaging portion of the support rib and the inner rib.

Third of all, a space part is formed at a lower side of the ascending and descending member, and in a state that the parasol rib assembly is folded, the second ascending and descending member rises and comes into contact with the lower side of the space part of the ascending and descending member, and the outer rib rotates 90° and becomes a half-unfolded state, so the outer rib of the parasol rib assembly does not contact with the hand of the user who ascends and descends the second ascending and descending member.

To achieve the above object, fourth of all, there is provided a parasol which includes a parasol shank body formed of a lower shank part to which a handle is engaged to its lower side, and an upper shank part which flexibly slides long the lower shank part, and engaging shoulders are formed at an upper side of the lower shank part and a lower side of the upper shank part, and engaging holes are formed above the engaging shoulders and overlap as the parasol shank body prolongs, and the parasol shank body is fixed in a prolonged state with the aid of the engaging protrusion elastically supported by means of a spring installed at an inner upper side of the engaging shoulder of the lower shank part, and a plurality of inner ribs are rotatably engaged in radial shape to the fixing member fixed at the top of the upper shank part, and the other end of each inner rib is pinned at a pin engaging part formed at the outer rib, and the outer rib is configured in such a way that the outer rib is exposed to the outside in a folded state, and at an inner end of the outer rib is formed a support part which is prolonged from the pin engaging part, and the support part can be supported on the lower side of the inner rib in an unfolded state of the outer ribs, and both ends of each support rib of the parasol rib assembly are rotatably engaged in a radial shape to the ascending and descending member which ascends and descends along the intermediate portion of the inner rib and the upper shank part of the parasol shank body, which comprises a tube shaped slide tube which is disposed between the upper shank part and the ascending and descending member and surrounds the upper shank part; and at the upper and lower sides of the slide tube are formed an upper shoulder for the purpose of maintaining an interval from the fixing member in a state that each ascending and descending member has risen in a folded state and a lower shoulder coming into contact with the lower side of the ascending and descending member when the ascending and descending member descends; and both ends of the pulling piece are rotatably engaged to the upper side of the slide tube and the support part formed at the inner end of the outer rib; and at the ascending and descending member are disposed two lower engaging parts at an angle interval of 90° in a circumferential direction which face one upper engaging part which is pressurized toward the upper shank part with the aid of the elastic force of the spring; and the upper engaging part has an engaging shoulder at its lower end portion and is inserted into the fixing holes formed at the slide tube and the upper side of the upper shank part so that the parasol rib assembly can communicate in a unfolded state of the parasol rib assembly; and two facing lower engaging parts have engaging shoulders at their upper sides and are inserted into facing fixing holes formed at the slide tube and the lower side of the upper shank part so that the parasol rib assembly can communicate in folded states.

Fifth of all, the inner rib is formed in an upside down U-shape, and the pulling piece does not escape from the inner rib by means of the pin of the engaging part to which the inner ribs and the support ribs are rotatably engaged.

Advantageous Effects

According to the parasol of the present invention, it does not need to manually unfold and fold with hands the outer ribs of the parasol rib assembly for thereby obtaining good convenience when in use.

The parasol according to the present invention can be easily applied to an ordinary parasol and it has a simple construction and a low price. Thanks to them, good parasol can be mass-produced while ensuring good convenience when in use. The parasol according to the present invention has high competitiveness as compared to other products in their prices and qualities.

<Descriptions of reference numerals>

Figure 1:
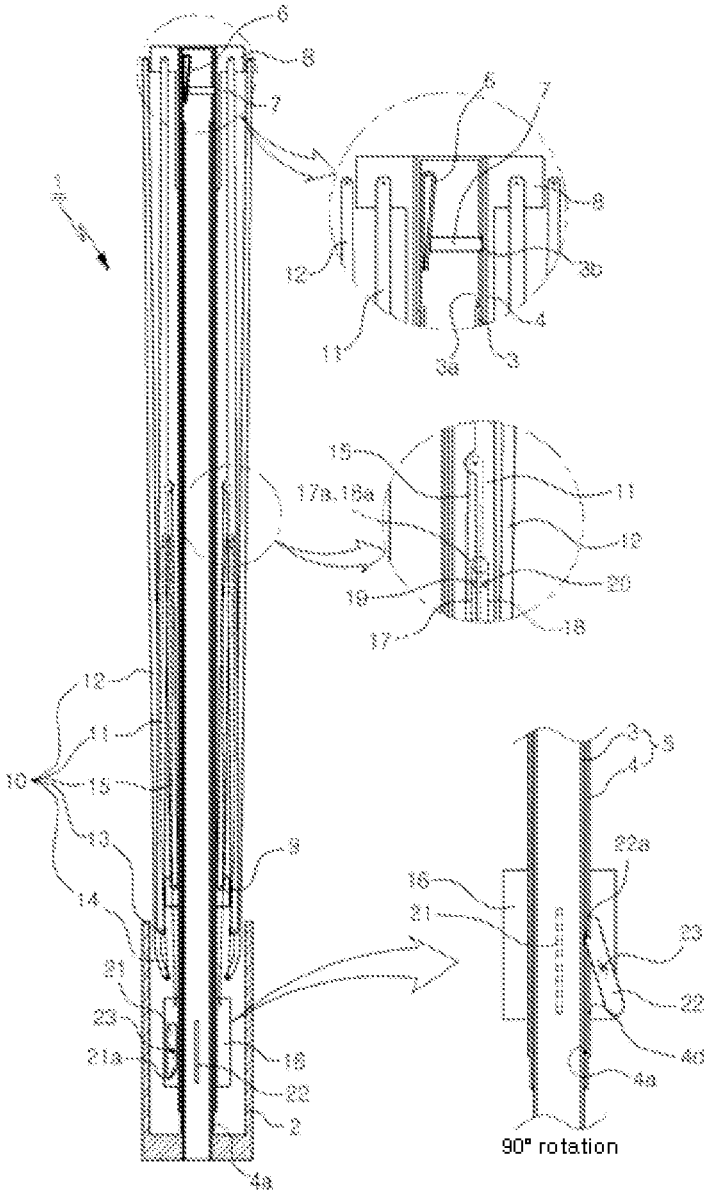
FIG. 1 is a cross sectional view illustrating a state that a parasol shank body is contracted in a state that a parasol rib assembly is folded according to a first embodiment of the present invention.

| | |
|---|---|
| 1: parasol | 2: handle |
| 3: lower shank part | 3a, 4a: engaging shoulder |
| 3b, 4b: engaging hole | 4c, 4d, 4e, 4f, 24c, 24d: fixing hole |
| 4: upper shank part | 5: parasol shank body |
| 6: spring | 7: engaging protrusion |
| 8: fixing member | 9: ascending and descending member |
| 9a: space part | 10: parasol rib assembly |
| 11: inner rib | 12: outer rib |

-continued

| <Descriptions of reference numerals> | |
|---|---|
| 13: pin engaging part | 14: support part |
| 15: support rib | 16: second ascending and descending member |
| 17: inner pulling piece | 17a, 18a: ring part |
| 18: outer pulling part | 19, 20: escape prevention pin |
| 21: upper engaging part | 21a, 22a: engaging shoulder |
| 22: lower engaging part | 23: spring |
| 24: slide tube | 24a: upper shoulder |
| 24b: lower shoulder | 25: pulling part |

MODES FOR CARRYING OUT THE INVENTION

The construction of the present invention will be described with reference to the accompanying drawings.

Figure 2:
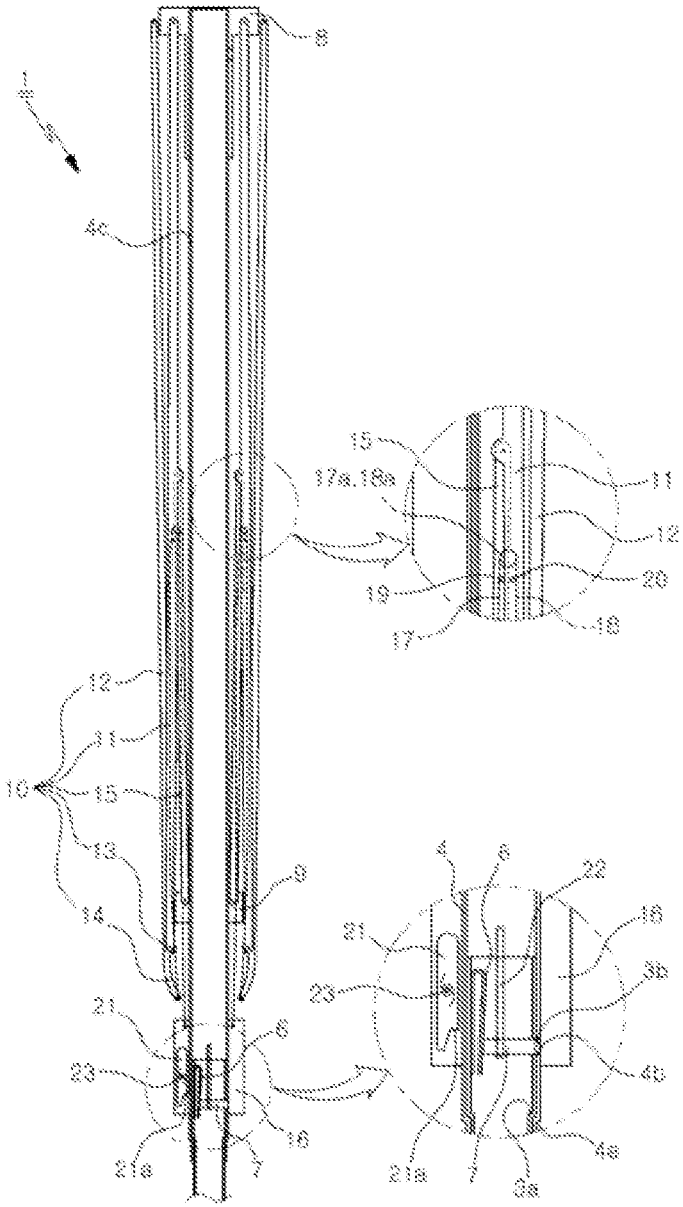
FIG. 2 is a cross sectional view illustrating a state that a parasol shank body is prolonged in a state that a parasol rib assembly is folded according to a first embodiment of the present invention.
Figure 3:
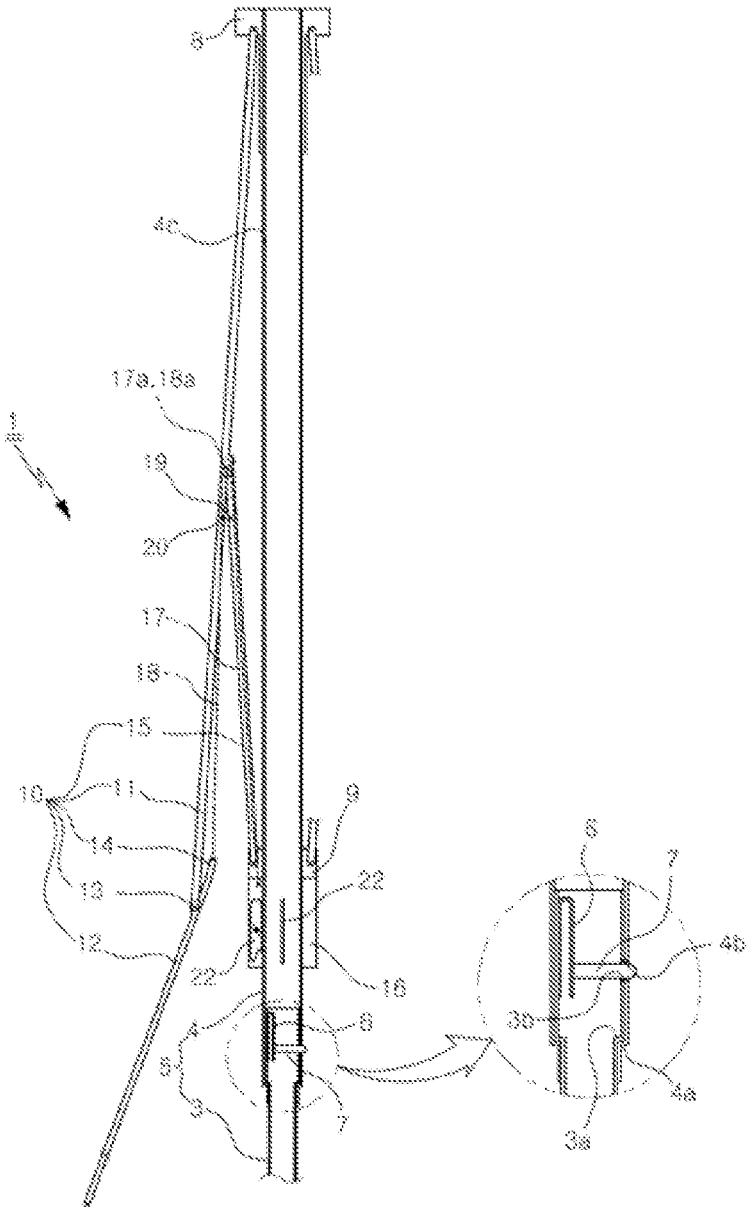
FIG. 3 is a cross sectional view illustrating a state that outer ribs of a parasol rib assembly rotate and are unfolded according to a first embodiment of the present invention.
Figure 4:
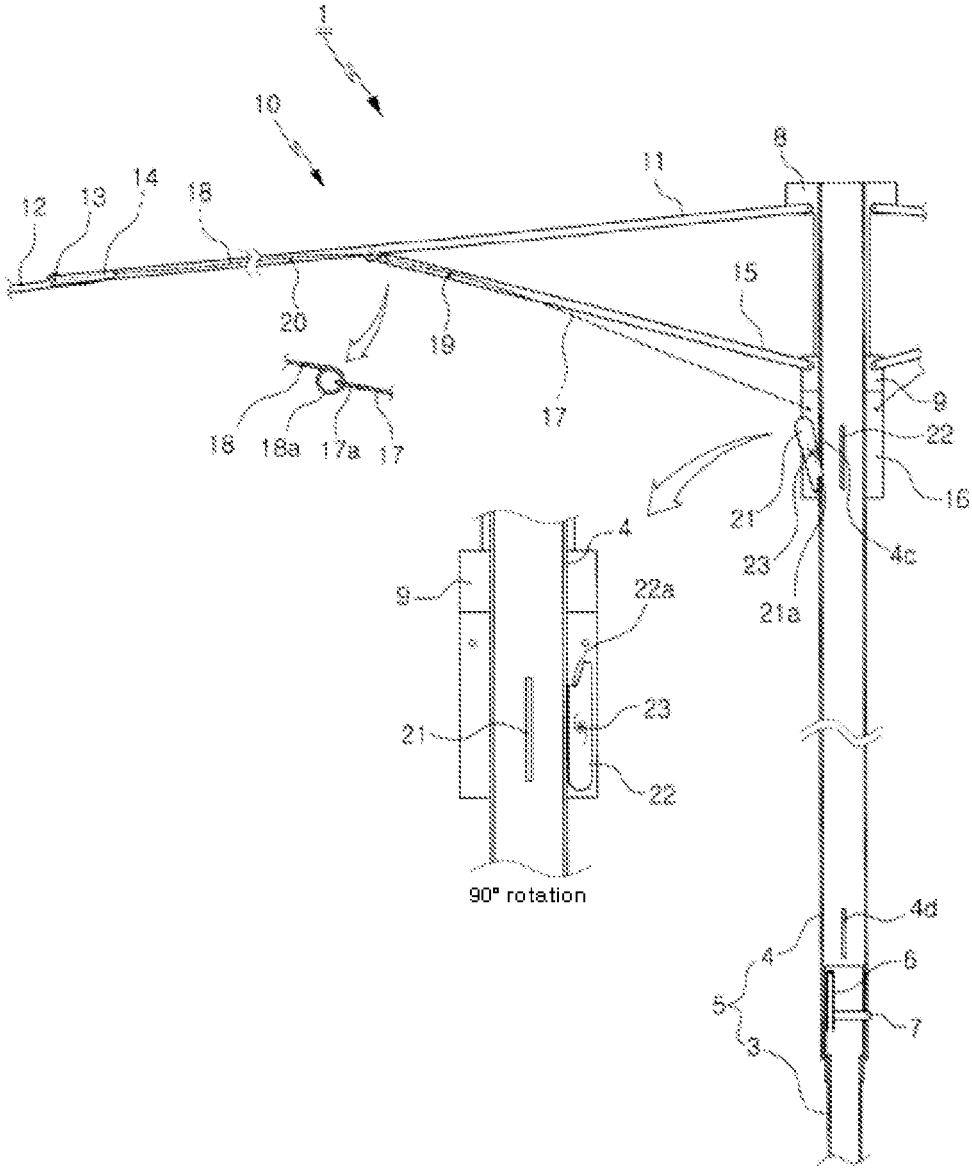
FIG. 4 is a cross sectional view illustrating a state that a parasol is unfolded according to a first embodiment of the present invention.

FIG. 1 is a cross sectional view illustrating a state that a parasol shank body is contracted in a state that a parasol rib assembly is folded according to a first embodiment of the present invention. FIG. 2 is a cross sectional view illustrating a state that a parasol shank body is prolonged in a state that a parasol rib assembly is folded according to a first embodiment of the present invention. FIG. 3 is a cross sectional view illustrating a state that outer ribs of a parasol rib assembly rotate and are unfolded according to a first embodiment of the present invention. FIG. 4 is a cross sectional view illustrating a state that a parasol is unfolded according to a first embodiment of the present invention.

As shown therein, the parasol 1 according to the present invention comprises a parasol shank body 5 formed of a lower shank part 3 at a lower end of which a handle 2 is engaged, and an upper shank part 4 which is contracted or slides and is prolonged from the lower shank part 3. Engaging shoulders 3*a* and 4*a* are formed at an upper end portion of the lower shank part 3 and a lower end portion of the upper shank part 4, respectively, so they are not disengaged when prolonged. Engaging holes 3*b* and 4*b* are formed above the engaging shoulders 3*a* and 4*a* of the lower shank part 3 and the upper shank part 4, which engaging holes 3*b* and 4*b* are overlapped in a stare that the parasol shank body 5 is prolonged, so the parasol shank body 5 can be fixed in a prolonged state with the aid of the engaging protrusion 7 which is elastically supported by means of the spring 6 installed in the upper inner side of the engaging shoulder 3*a* of the lower shank part 3, and a parasol rib assembly 10 to which a parasol cloth is fixed is engaged at the parasol shank body 5.

The parasol rib assembly 10 is engaged in a radial shape at a fixing member 8 fixed at the top of the upper shank part 4 in such a way that a plurality of inner ribs 11 are rotatable. The other ends of the inner ribs 11 are rotatably engaged, by way of pins, at the pin engaging parts 13 formed at the outer ribs 12, and the outer ribs 12 are configured for the outer ribs 12 to be exposed to the outside in a folded state. At the inner end portion of the outer rib 12 is formed a support part 14 extended from the pin engaging part 13, so the support part 14 can be supported on the lower portion of the inner rib 11 in a unfolded state of the outer ribs 12.

In addition, both ends of each support rib 15 are rotatably engaged in a radial shape at the ascending and descending member 9 which ascends and descends along the intermediate portion of the inner rib 11 and the upper shank part 4 of the parasol shank body 5.

The above described construction is almost same as the construction of a conventional parasol which is widely used.

The present invention is directed to resolving the inconveniences occurring as the user unfolds and folds with hands each outer rib 12 of the parasol rib assembly 10 in such a way to improve the construction of the parasol 1.

In the present invention, below the ascending and descending member 9 is provided a second ascending and descending member 16 which slides along the upper shank part 4 and allows it to be inserted into the handle 2 when contracting the parasol shank body 5 in a state that the parasol rib assembly 10 is folded.

The second ascending and descending member 16 remains spaced apart a little from the lower side of the ascending and descending member 9 in a state that the parasol rib assembly 10 is folded. In other word, it is an element which allows the outer ribs 12 of the parasol rib assembly 10 to rotate and unfold as the inner pulling piece 17 and the outer pulling piece 18 are pulled while coming into contact with the ascending and descending member 9 when the second ascending and descending member 16 is moved upward so as to unfold the parasol rib assembly 10.

The inner pulling piece 17 and the outer pulling piece 18 interconnected by means of the ring parts 17*a* and 18*a* are rotatably engaged at the support parts 14 which are formed at the second ascending and descending member 16 and the inner end portions of the outer ribs 12.

The support ribs 15 and the inner ribs 11 are formed in upside down U-shapes and are forced to face one another, and when the parasol rib assembly 10 is folded, the inner pulling piece 17 and the outer pulling piece 18 are configured in such a way that the portion just below the connection parts interconnected by means of the ring parts 17*a* and 18*a* does not disengage in a state that they are inserted in the support ribs 15 and the inner ribs 11 by means of the escape prevention pins 19 and 20 which face each other at the portions just below the engaging portions of the support ribs 15 and the inner ribs 11.

In addition, an upper engaging part 21 and a lower engaging part 22 pressurized in the directions of the upper shank part 4 by means of an elastic support force of the spring 23 are installed at the second ascending and descending member 16 in a circumferential direction at an angle interval of 90° so that the parasol rib assembly 10 can be fixed in a unfolded state and a folded state.

The upper engaging part 21 has an engaging shoulder 21*a* at its lower side, and the engaging shoulder 21*a* is inserted into the fixing hole 4*c* formed at the upper side of the upper shank part 4 of the parasol shank body 5 in a state that the parasol rib assembly 10 is unfolded. In addition, the lower engaging part 22 has an engaging shoulder 22*a* at its upper side and is inserted into the fixing hole 4*d* formed at a lower side of the upper shank part 4 in a state that the parasol rib assembly 10 is folded.

When a user uses a parasol 1 in a state that the parasol 1 of the present invention is folded as shown in FIG. 1, the user holds with hands the folded parasol rib assembly 10 and pulls the handle 2, so the contracted upper shank part 4 and low shank part 3 of the parasol shank body 5 are prolonged. At this time, the lower shank part 3 and the upper shank part 4 are fixed by means of the engaging shoulders 3*a* and 4*a*, and the engaging protrusion 7 elastically supported by the spring 6 installed at the upper inner portion of the engaging shoulder 3*a* of the lower shank part 3 as the engaging holes 3*b* and 4*b* are overlapped becomes a construction of FIG. 2 while ensuring a contact with the lower side of the second ascending and descending member 16 by way of the engaging holes 3*b* and 4*b*.

With the parasol body 5 being prolonged, the lower portion of the lower engaging part 22 installed at the second ascending and descending member 16 and externally protruded from the second ascending and descending member 16 is pushed by a users finger, and the engaging shoulder 22*a* formed at the top of the lower engaging part 22 is separated from the fixing hole 4*d* formed at the lower side of the upper shank part 4, thus pushing upward the second ascending and descending member 16. As the second ascending and descending member 16 is pushed upward, the engaging protrusion 7 coming into contact with the lower side of the second ascending and descending member 16 protruded from the overlapping engaging holes 3*b* and 4*b*, so the upper shank part 4 and the lower shank part 3 are fixed in prolonged states. The upper engaging part 21 comes into contact with the upper shank part 4, so it does not protrude to the outside of the second ascending and descending member 16, so there is not any interference when selecting the lower engaging part 22 and pushing it with a finger.

At this time, as the inner pulling piece 17 rotatably connected with the second ascending and descending member 16 moves upward, it moves the connection part of the outer pulling piece 18 interconnected by the inner pulling piece 17 and the ring parts 17*a* and 18*a* up to the portion just below the engaging part rotatably engaging the inner ribs 11 and the support ribs 15 while pulling the support part 14 of the outer ribs 12 rotatably connected with the outer pulling piece 18 for thereby rotating the outer ribs 12 and unfolding them, so a construction state as shown in FIG. 3 is obtained.

Since the inner pulling piece 17 and the outer pulling piece 18 are formed in the upside down U-shapes and are inserted into the support ribs 15 and the inner ribs 11 by means of the facing escape prevention pins 19 and 20 just below the engaged portion of the facing support ribs 15 and the inner ribs 11, so the ascending and descending member 9 stays almost stopped even when the second ascending and descending member 16 is pushed up.

When the outer ribs 12 rotate and are unfolded, the second ascending and descending member 16 reaches the lower side of the ascending and descending member 9 while coming into contact with it. In this state, when the second ascending and descending member 16 is continuously pushed, the ascending and descending member 9 engaged with the support ribs 15 moves upward together, and the parasol rib assembly 10 is unfolded like the conventional parasol. At the same time, when the second ascending and descending member 16 ascends with the aid of the interval between the engaging part of the support ribs 15 rotatably engaged to the ascending and descending member 9 and the engage part of the inner pulling piece 17 rotatably engaged to the second ascending and descending member 16, the connection part where the inner pulling piece 17 and the outer pulling piece 18 are interconnected by means of the ring parts 17*a* and 18*a* approaches the engaging part where the inner ribs 11 and the support ribs 15 are rotatably engaged, the outer pulling piece 18 pulls the support part 14 of the outer ribs 12, and the support part 14 of the outer ribs 12 comes into close contact with the inner ribs 11, so the parasol rib assembly 10 can be fully unfolded. In a state that the parasol rib assembly 10 is fully unfolded, the engaging shoulder 21*a* formed at the lower side of the upper engaging part 21 installed at the second ascending and descending member 16 is inserted into the fixing hole 4*c* formed at the upper side of the upper shank part 4, so the parasol rib assembly 10 can be fixed in a unfolded state as shown in FIG. 4.

The inner pulling piece 17 and the outer pulling piece 18 are unfolded or folded at the angles similar with those of the support ribs 15 and the inner ribs 11 in such a way that with the connection part interconnected by means of the ring parts 17*a* and 18*a* being close to the engaging part where the inner ribs 11 and the support ribs 15 are rotatably engaged, the second ascending and descending part 16 is moved upward or downward, and when the parasol rib assembly 10 is unfolded or folded, the inner pulling piece 17 and the outer pulling piece 18 are inserted by means of the facing escape prevention pins 19 and 20 formed below the engaged portion of the upside down U-shaped support rib 15 and the inner rib 11, so there is not any force loss which might occur owing to an interference when unfolding or folding the parasol 1.

When a user folds to the parasol 1 after it is used in the unfolded state, the parasol rib assembly 10 operates in a reverse order when the parasol 1 is unfolded. In a state of FIG. 4, the upper portion of the upper engaging part 21 installed at and externally protruded from the second ascending and descending member 16 is pushed with a finger, and the engaging shoulder 21*a* of the upper engaging part 21 is separated from the upper fixing hole 4*c* of the upper shank part 4, and then the second ascending and descending member 16 is pulled downward. Since the lower engaging part 22 comes into contact with the upper shank part 4 and is not externally protruded from the second ascending and descending member 16, there is not any problem in selecting and pressing the upper engaging part 21.

As the engaging shoulder 21*a* of the upper engaging part 21 is separated from the fixing hole 4*c* and the second ascending and descending member 16 is pulled downward, the inner pulling piece 17 rotatably engaged to the second ascending and descending member 16 is inserted into the support rib 15 with the aid of the escape prevention pin 19, so the ascending and descending member 9 to which the support rib 15 is rotatably engaged moves downward. At this time, the support rib 15 rotatably engaged to the ascending and descending member 9 rotates downward along with the inner rib 11, and the support rib 15 and the inner rib 11 come into almost contact with the upper shank part 4, and the outer rib 12 does not rotate and stays as shown in FIG. 3.

As shown in FIG. 3, when the second ascending and descending member 16 is continuously pulled downward, the ascending and descending member 9 remains stopped, and the inner pulling piece 17 rotatably engaged to the second ascending and descending member moves downward and holds and pulls the outer pulling piece 18 interconnected with the inner pulling piece 17 by way of the ring parts 17*a* and 18*a*, and the outer pulling piece 18 comes to push the support part 14 of the rotatably engaged outer rib 12, and the outer rib 12 rotates and is folded, and when the engaging shoulder 22*a* of the lower engaging part 22 installed at the second ascending and descending member 16 is inserted into the fixing hole 4*d* formed at the lower side of the upper shank part 4, the parasol rib assembly 10 is fixed in a fully folded state, and the lower end portion of the second ascending and descending member 16 pushes the engaging protrusion 7 externally protruded from the upper shank part 4 via the engaging holes 3*b* and 4*b*, so the lower shank part 3 becomes slidable along the upper shank part 4 as shown in FIG. 2. In this state, the user holds the folded parasol rib assembly 10 with a hand and pushes the handle 2, and the prolonged lower shank part 3 and the upper shank par 4 of the parasol shank body 5 are contracted and stored as shown in FIG. 1.

Figure 5:
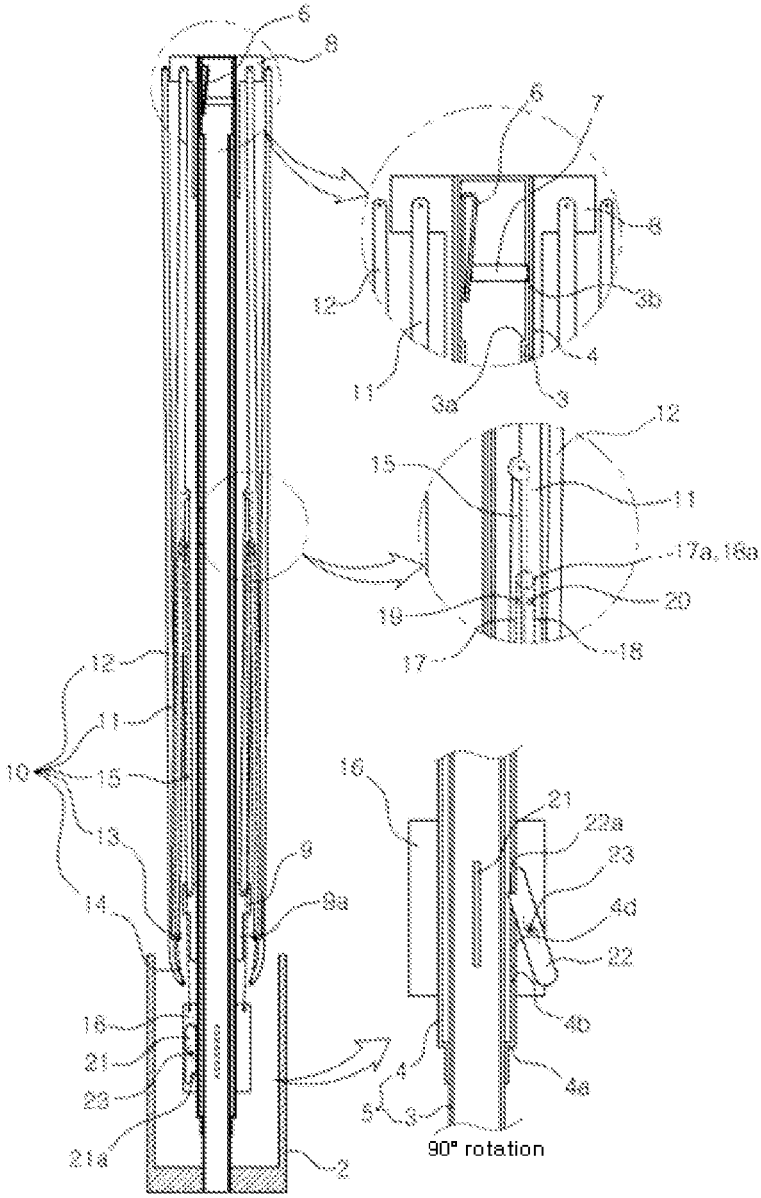
FIG. 5 is a cross sectional view illustrating a state that a parasol shank body is contracted in a state that a parasol rib assembly is folded according to a second embodiment of the present invention.
Figure 6:
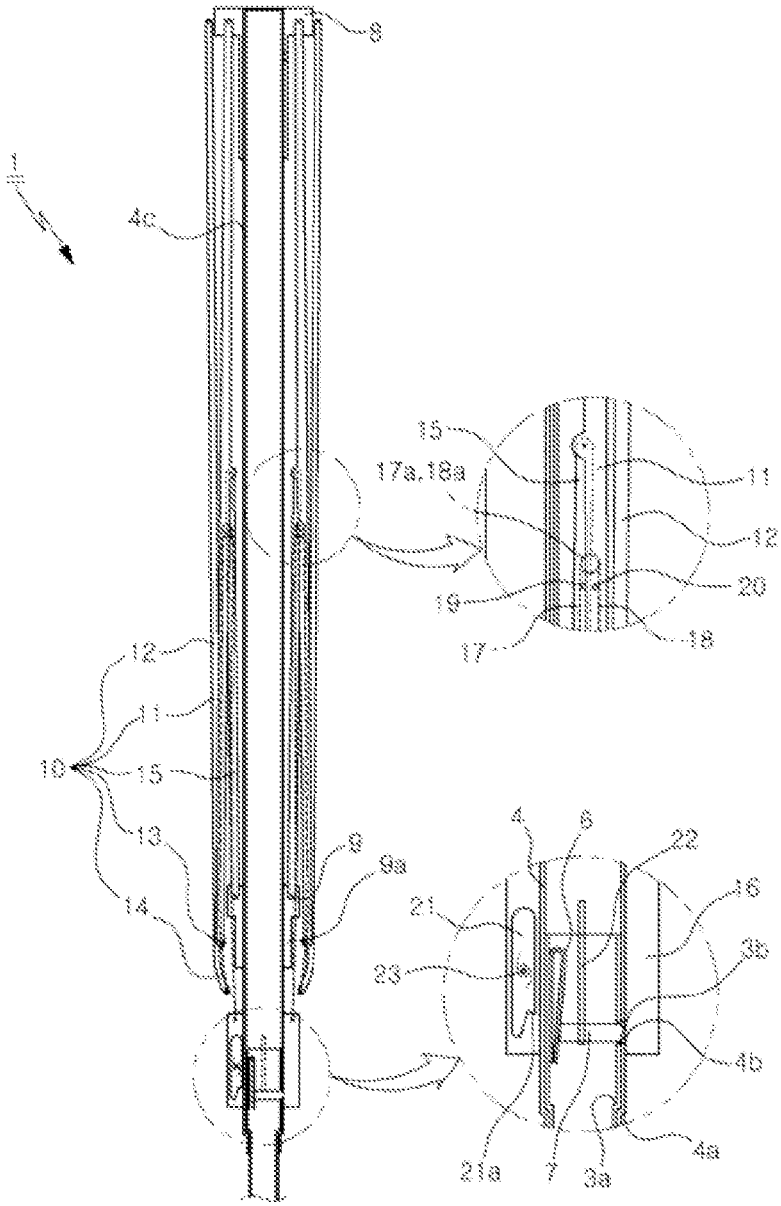
FIG. 6 is a cross sectional view illustrating a state that a parasol shank body is prolonged in a state that a parasol rib assembly is folded according to a second embodiment of the present invention.
Figure 7:
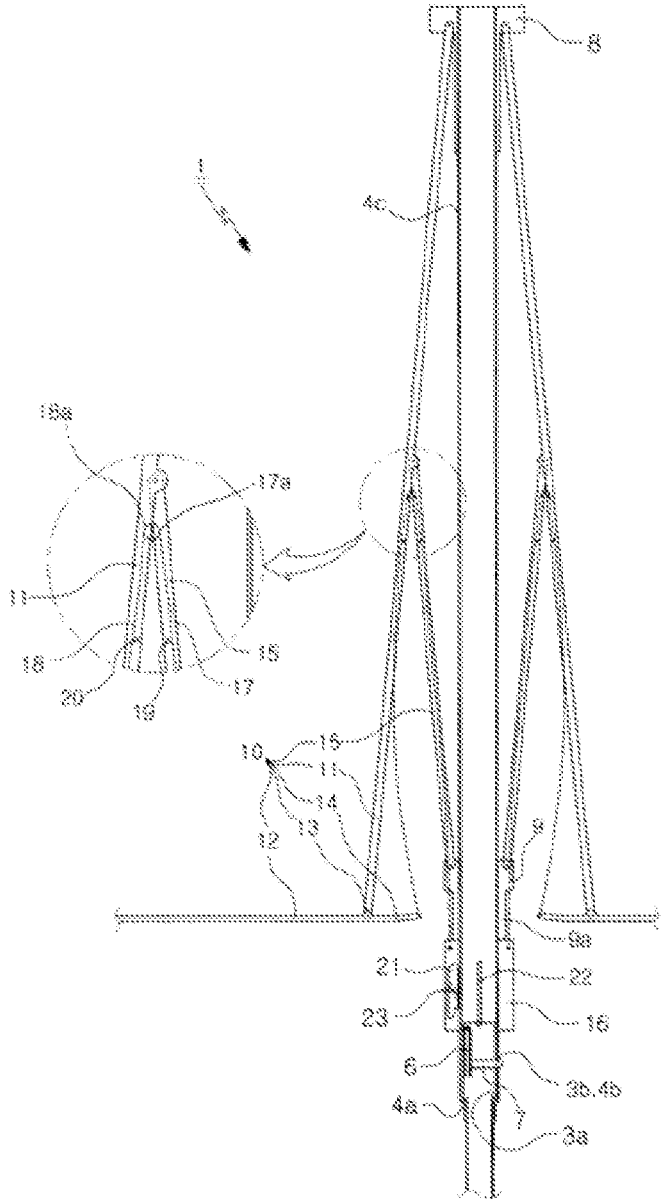
FIG. 7 is a cross sectional view illustrating a state that outer ribs of a parasol rib assembly rotate and are half-unfolded according to a second embodiment of the present invention.
Figure 8:
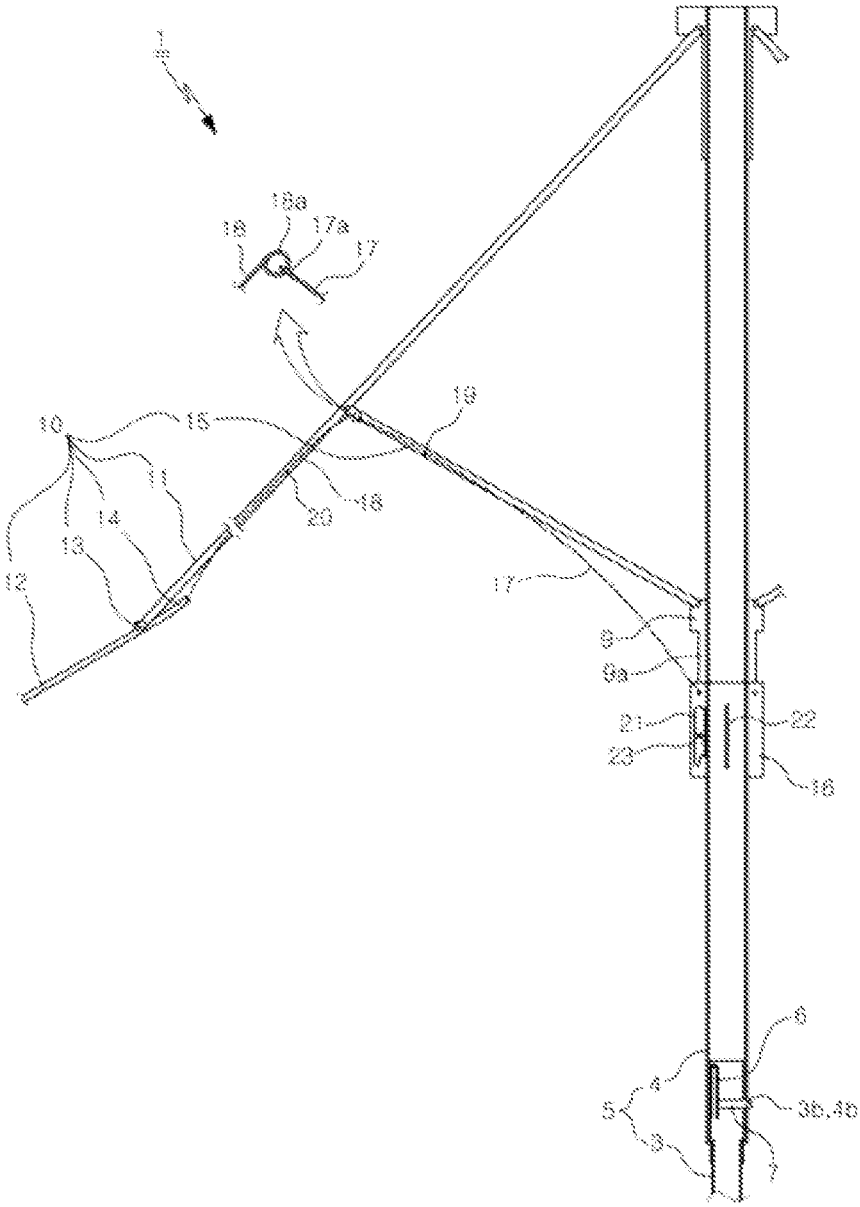
FIG. 8 is a cross sectional view illustrating a state that outer ribs of a parasol rib assembly rotate and are fully unfolded according to a second embodiment of the present invention.
Figure 9:
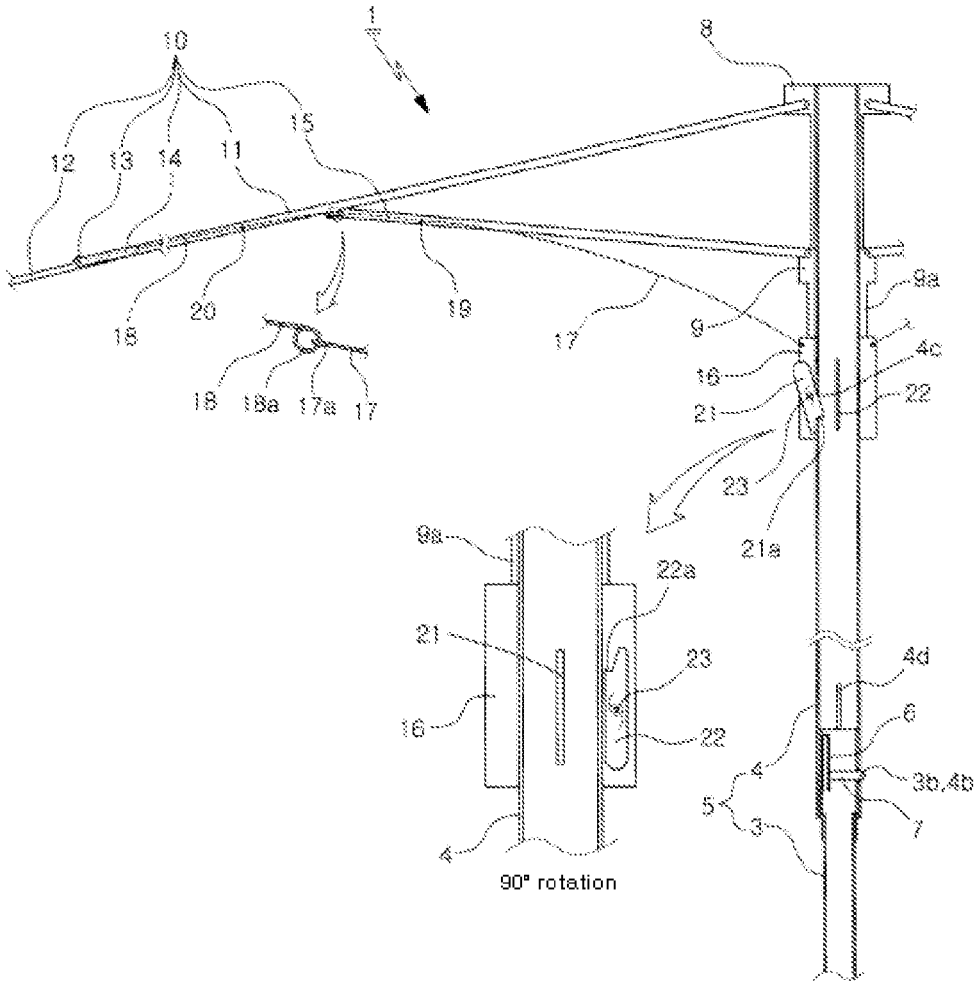
FIG. 9 is a cross sectional view illustrating a state that a parasol is unfolded according to a second embodiment of the present invention.

FIG. 5 is a cross sectional view illustrating a state that a parasol shank body is contracted in a state that a parasol rib assembly is folded according to a second embodiment of the present invention. FIG. 6 is a cross sectional view illustrating a state that a parasol shank body is prolonged in a state that a parasol rib assembly is folded according to a second embodiment of the present invention. FIG. 7 is a cross sectional view illustrating a state that outer ribs of a parasol rib assembly rotate and are half-unfolded according to a second embodiment of the present invention. FIG. 8 is a cross sectional view illustrating a state that outer ribs of a parasol rib assembly rotate and are fully unfolded according to a second embodiment of the present invention. FIG. 9 is a cross sectional view illustrating a state that a parasol is unfolded according to a second embodiment of the present invention.

The parasol 1 according to the second embodiment of the present invention is characterized in that it is constructed like the first embodiment except that the outer rib 12 of the parasol rib assembly 10 does not come into contact with the hands of the user who raises or lowers the second ascending and descending member 16.

In other words, in order to provide the above described functions, the second embodiment of the present invention is characterized in that a space part 9*a* is formed at a lower side of the ascending and descending member 9. With the above mentioned construction, when the second ascending and descending member 16 ascends with the parasol rib assembly 10 folded and comes into contact with the lower side of the space part 9*a* of the ascending and descending member 9, the outer rib 12 rotates 90° and becomes a half-unfolded state.

When using the parasol 1 according to a second embodiment of the present invention, the user holds the folded parasol rib assembly 10 as shown in FIG. 5 and pulls down the handle 2 and prolongs the contracted upper shank part 4 and lower shank part 3 of the parasol shank body 5 as shown in FIG. 6.

In a state that the parasol shank body 5 is prolonged, the lower side of the lower engaging part 22 installed at the second ascending and descending member 16 and externally protruded from the second ascending and descending member 16 is pushed by a finger, and the engaging shoulder 22*a* formed at the upper side of the lower engaging part 22 is separated from the fixing hole 4*d* formed at the lower side of the upper shank part 4, and the second ascending and descending part 16 is pushed upward. At this time, the upper shank part 4 and the lower shank part 3 are fixed in prolonged states as the engaging protrusion 7 protruded via the overlapping engaging holes 3*b* and 4*b*.

The inner pulling piece 17 and the outer pulling piece 18 are formed in upside down U-shapes and are inserted in the support rib 15 and the inner rib 11 by means of the escape prevention pins 19 and 20 which face each other and are formed at the lower side of the engaged portions of the facing support rib 15 and inner rib 11. So, even when the second ascending and descending member 16 is pushed upward, the ascending and descending member 9 stays almost stopped.

The second ascending and descending member 16 which were pushed upward come into contact with the lower side of the space part 9*a* formed at the lower side of the ascending and descending part 9. At this time, the inner pulling piece 17 rotatably connected to the second ascending and descending member 16 moves upward as much as the distance that the second ascending and descending member 16 has moved until to come into contact with the lower side of the space part 9*a* of the ascending and descending member 9 and moves upward the outer pulling piece 18 interconnected with the inner pulling piece 17 by means of the ring parts 17*a* and 18*a* and pulls the support part 14 of the outer rib 12 rotatably connected with the outer pulling piece 18, so the outer rib 12 of the parasol rib assembly 10 rotates about 90° and becomes a half-unfolded state as shown in FIG. 7 so that it does not come into contact with the hand holding the second ascending and descending member 16. In this state, when the second ascending and descending member 16 is continuously pushed upward, the ascending and descending member 9 to which the support rib 15 is rotatably engaged ascends together, and the support rib 15 and the inner rib 11 rotate and are unfolded, and at the same time when the second ascending and descending member 16 moves upward by means of the interval between the engaged portion of the support rib 15 rotatably engaged to the ascending and descending member 9 and the engaged portion of the inner pulling piece 17 rotatably engaged to the second ascending and descending member 16. As for the inner pulling piece 17 and the outer pulling piece 18, as the connection part interconnected by means of the ring parts 17*a* and 18*a* approach the engaged portion where the inner rib 11 and the support rib 15 are rotatably engaged, the outer pulling piece 18 pulls the support part 14 of the outer rib 12, and the outer rib 12 rotates and is unfolded like an almost straight line from the inner rib 11, and the connected portion of the inner pulling piece 17 and the outer pulling piece 18 becomes close to the engaged portion where the inner rib 11 and the support rib 15 are rotatably engaged as shown in FIG. 8. In this state, when the second ascending and descending member 16 is continuously pushed upward, the ascending and descending member 9 to which the support rib 15 is engaged keeps rising, and the parasol rib assembly 10 is unfolded like the conventional parasol, and at the same time the connection portion of the inner pulling piece 17 and the outer pulling piece 18 becomes closer to the engaged portion of the inner rib 11 and the support rib 15 with the aid of the interval between the engaged portion of the support rib 15 rotatably engaged to the ascending and descending member 9 and the engage portion of the inner pulling piece 17 rotatably engaged to the second ascending and descending member 16, so the outer pulling piece 18 pulls the support part 14 of the outer rib 12, and the support part 14 of the outer rib 12 comes into close contact with the inner rib 11, so the parasol rib assembly 10 is fully unfolded. In the thusly fully unfolded state, the engaging shoulder 21*a* of the upper engaging part 21 installed at the second ascending and descending member 16 is inserted into the fixing hole 4*c* formed at the upper side of the upper shank part 4, so the parasol 1 is fixed in a unfolded state as shown in FIG. 9.

When a user wants to fold the parasol 1 after it is used in an unfolded state, the parasol rib assembly 10 works in the reverser order when the parasol 1 is unfolded. In a state of FIG. 9, the upper portion of the upper engaging part 21 installed at the second ascending and descending member 16 and externally protruded from the second ascending and descending member 16 is pushed by a finger, and the engaging shoulder 21*a* formed at the lower side of the upper engaging part 21 is separated from the upper fixing hole 4*c* of the upper shank part 4, and the second ascending and descending member 16 is pulled downward.

In such a way, when the engaging shoulder 21*a* of the upper engaging part 21 is separated from the fixing hole 4*c*, and the second ascending and descending member 16 is pulled downward, the ascending and descending member 9 moves downward while coming into contact with the second ascending and descending member 16. At this time, the support rib 15 and the inner rib 11 rotatably engaged to the ascending and descending member 9 rotate and are folded as shown in FIG. 8, and when the second ascending and descending member 16 descends with the aid of the interval between the engaged portion of the support rib 15 rotatably engaged to the ascending and descending member 9 and the engaged portion of the inner pulling piece 17 rotatably engaged to the second ascending and descending member 16, the connected part interconnected with the inner pulling piece 17 and the outer pulling piece 18 by means of the ring parts 17*a* and 18*a* is spaced apart from the engaged portion rotatably engaged to the inner rib 11 and the support rib 15, and the support rib 15, the inner rib 11 and the outer rib 12 all rotate together, and the support rib 15 and the inner rib 11 come into almost contact with the upper shank part 4, and the outer rib 12 is half-folded, and the ascending and descending member 9 stops as shown in FIG. 7. In the above state, when the second ascending and descending member 16 is continuously pulled downward, the inner pulling piece 17 which is rotatably engaged with the second ascending and descending member 16 moves downward and pulls the outer pulling piece 18 interconnected with the inner pulling piece 17 by means of the ring parts 17*a* and 18*a* and pushes the support part 14 of the outer rib 12 rotatably engaged to the outer pulling piece 18, and the outer rib 12 rotates and is folded, and the engaging shoulder 22*a* of the lower engaging part 22 installed at the second ascending and descending member 16 is inserted into the fixing hole 4*d* formed at the lower side of the upper shank part 4, and the parasol rib assembly 10 is fixed in a fully folded state, and at the same time the lower side of the second ascending and descending member 16 pushes the engaging protrusion 7 externally protruded from the upper shank part 4 via the engaging holes 3*b* and 4*b*, and the lower shank part 3 can slide along the upper shank part 4 as shown in FIG. 6. In this state, the user holds the parasol rib assembly 10 and pushes the handle 2, so the prolonged upper shank part 4 and lower shank part 3 of the parasol shank body 5 can be stored in the contracted state as shown in FIG. 5.

Figure 10:
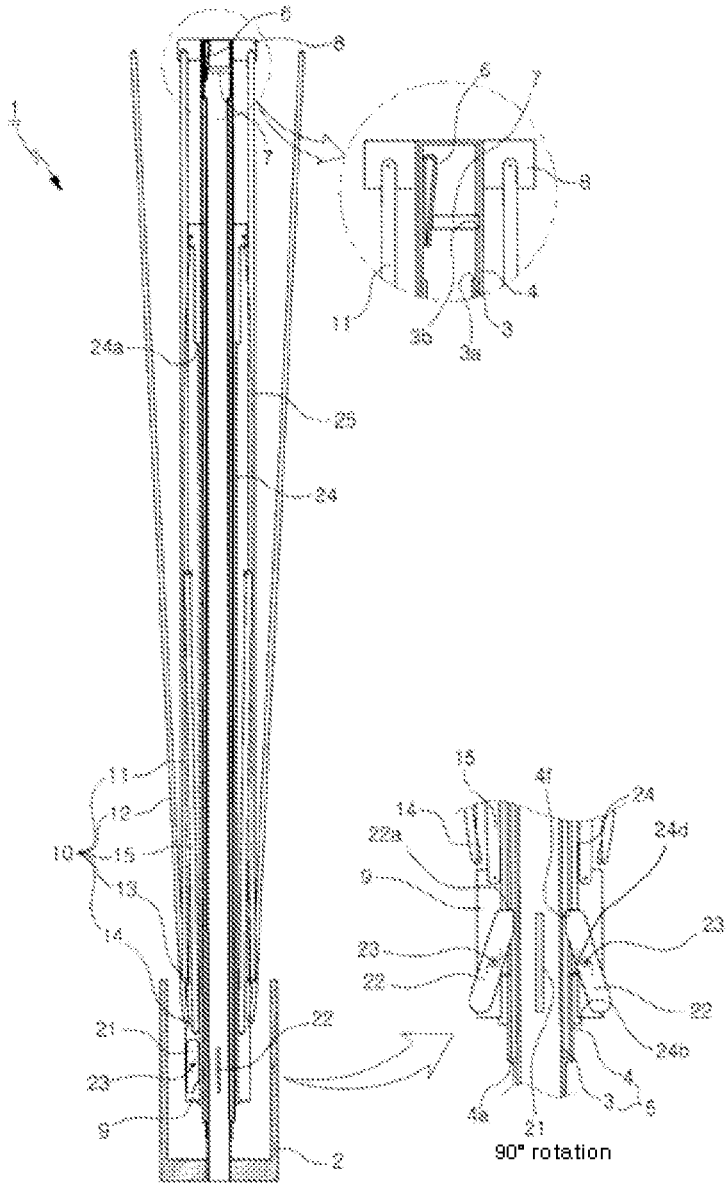
FIG. 10 is a cross sectional view illustrating a state that a parasol shank body is contracted in a state that a parasol rib assembly is folded according to a third embodiment of the present invention.
Figure 11:
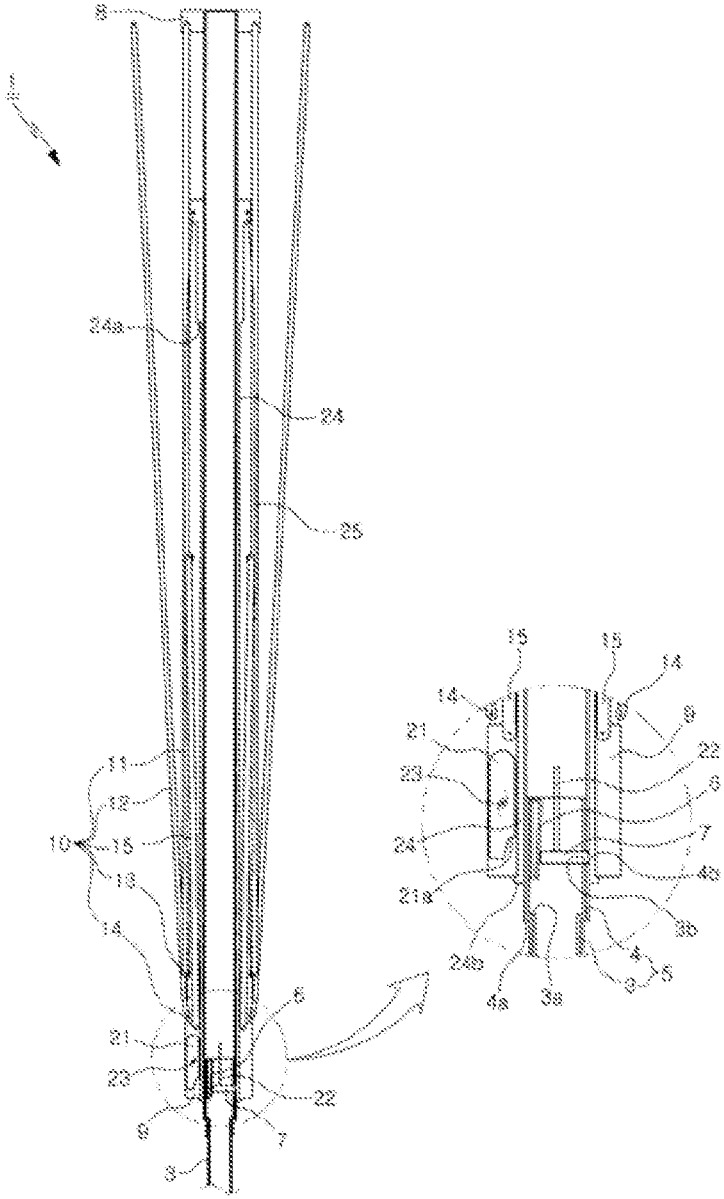
FIG. 11 is a cross sectional view illustrating a state that a parasol shank body is prolonged in a state that a parasol rib assembly is folded according to a third embodiment of the present invention.
Figure 12:
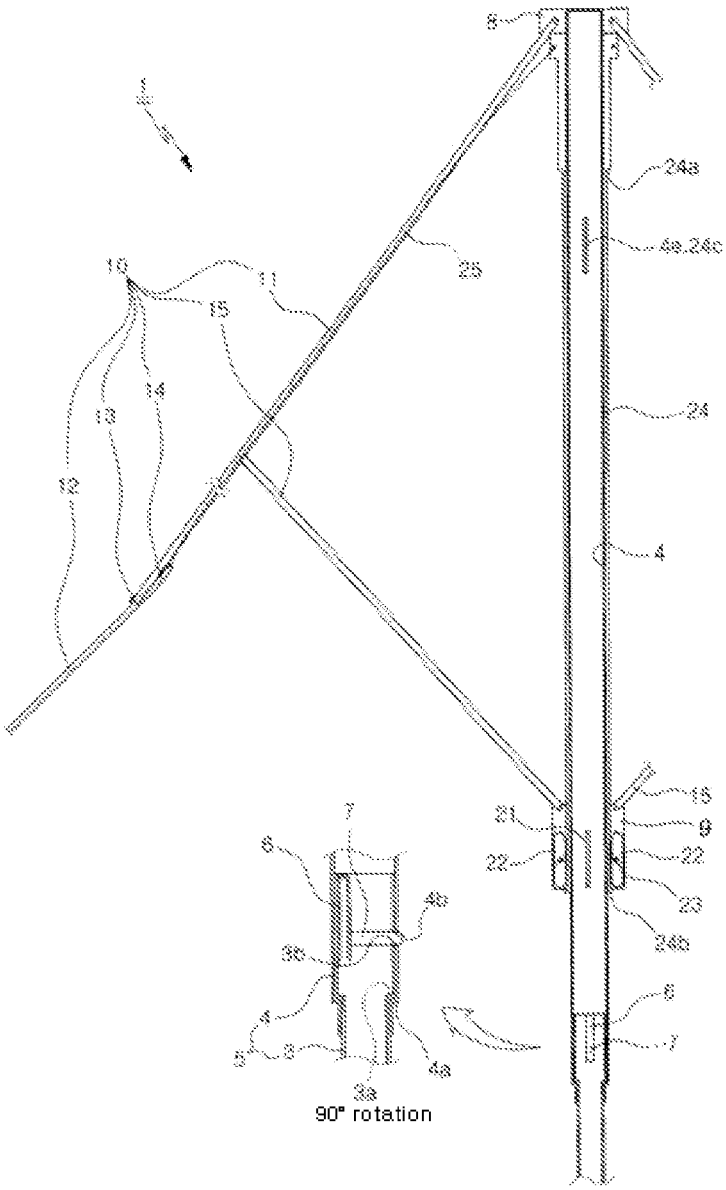
FIG. 12 is a cross sectional view illustrating a state that outer ribs of a parasol rib assembly rotate and are unfolded according to a third embodiment of the present invention.
Figure 13:
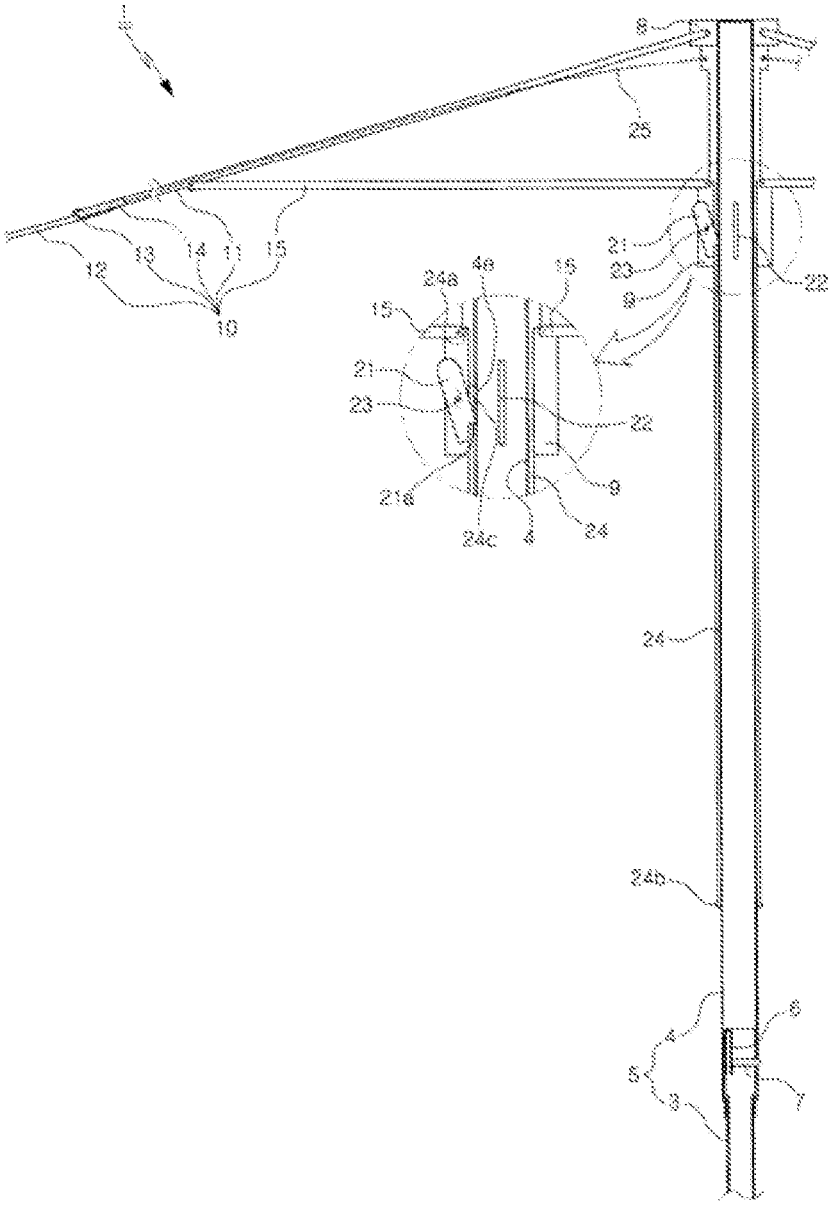
FIG. 13 is a cross sectional view illustrating a state that a parasol is unfolded according to a third embodiment of the present invention.

FIG. 10 is a cross sectional view illustrating a state that a parasol shank body is contracted in a state that a parasol rib assembly is folded according to a third embodiment of the present invention. FIG. 11 is a cross sectional view illustrating a state that a parasol shank body is prolonged in a state that a parasol rib assembly is folded according to a third embodiment of the present invention. FIG. 12 is a cross sectional view illustrating a state that outer ribs of a parasol rib assembly rotate and are unfolded according to a third embodiment of the present invention. FIG. 13 is a cross sectional view illustrating a state that a parasol is unfolded according to a third embodiment of the present invention.

The parasol 1 according to the present invention comprises a parasol shank body 5 consisting of a lower shank part 3 to a lower end of which the handle 2 is engaged, and an upper shank part 4 which can slide along the lower shank part 3 and which is contracted, and at the upper portion of the lower shank part 3 and the lower portion of the upper shank part 4 are formed the engaging shoulders 3*a* and 4*a*, so they cannot be randomly disconnected in an elongated state. Engaging holes 3*b* and 4*b* are formed above the engaging shoulders 3*a* and 4*a* of the lower shank part 3 and the upper shank part 4 and are overlapped in a state that the parasol shank body 5 is prolonged, so the parasol shank body 5 can be fixed in a prolonged state by means of the engaging protrusion 7 elastically supported by a spring 6 installed in the upper inner side of the engaging shoulder 3*a* of the lower shank part 3.

The parasol rib assembly 10 is engaged to the parasol shank body 5 with a parasol cloth engaged to the parasol rib assembly 10.

The parasol rib assembly 10 is characterized in that a plurality of inner ribs 11 are rotatably engaged in a radial shape to the fixing member 8 which is fixed at the top of the upper shank part 4. The other end of the inner rib 11 is rotatably engaged to the pin engaging part 3 formed at the outer rib 12 by way of a pin, and the outer rib 12 is constructed in such a way that the outer rib 12 is constructed to be externally exposed in a folded state, and a support part 14 extended from the pin engaging part 13 is formed at the inner end of the outer rib 12, so the support part 14 can be supported on the lower end of the inner rib 11 with the outer rib 12 being unfolded.

Both ends of each support rib 15 are rotatably engaged in a radial shape to the ascending and descending member 9 which ascends and descends along the intermediate portion of the inner rib 11 and the upper shank part 4 of the parasol shank body 5.

The above described construction is almost same as the construction of the conventional parasol.

When constructing the parasol 1 according to a third embodiment of the present invention, it is possible to prevent inconveniences that the user manually unfolds and folds the outer ribs 12 of the parasol rib assembly 10.

In the present invention, there is further provided a tube-shaped slide tube 24 disposed between the upper shank part 4 and the ascending and descending member 9 and surrounds the upper shank part 4.

At the upper and lower sides of the slide tube 24 is provided an upper shoulder 24*a* which is spaced apart from the fixing member 8 in a state that each ascending and descending member 9 ascends and contacts, and a lower shoulder 24*b* is provided, to which the lower side of the ascending and descending member 9 comes into contact when the ascending and descending member 9 descends.

Both ends of the pulling piece 25 are rotatably engaged to the support part 14 which is formed at the top of the slide tube 24 and the inner end portion of the outer rib 12.

The inner rib 11 is formed in an upside down U-shape, and the pulling piece 25 does not escape from the inner rib 11 with the aid of the intermediate portion of the inner rib 11 and the pin of the engaging part to which the support rib 15 is rotatably engaged.

At the ascending and descending member 9 are provided two lower engaging parts 22 at an angle interval of 90° in a circumferential direction while facing one upper engaging part 21 which is pressurized toward the upper shank part 4 with the aid of the elastic force of the spring 23 so that the parasol rib assembly 10 can be fixed in the unfolded state and the folded state.

At the lower side of the upper engaging part 21 is formed an engaging shoulder 21*a*, and the engaging shoulder 21*a* is inserted in the fixing holes 24*c* and 4*e* formed at the upper sides of the slide tube 24 and the upper shank part 4 so that the parasol rib assembly 10 can communicate in an unfolded state.

The facing two lower engaging parts 22 have engaging shoulders 22*a* at their top portions, and the engaging shoulders 22*a* are fixedly inserted in the facing fixing holes 24*d* and 4*f* formed at the lower sides of the slide tube 24 and the upper shank part 4 so that the parasol rib assembly 10 can communicate in a folded state.

When a user wants to use the parasol 1 of the third embodiment of the present invention in a folded state as shown in FIG. 10, the user holds the folded parasol rib assembly 10 and pulls the handle 2, so the contracted upper shank part 4 and lower shank part 3 of the parasol shank body 5 are prolonged. At this time, the lower shank part 3 and the upper shank part 4 are fixed by means of the engaging shoulders 3*a* and 4*a*, and the engaging protrusion 7 elastically supported by means of the spring 6 installed at the upper inner portion of the engaging shoulder 3*a* of the lower shank part 3 where the engaging holes 3*b* and 4*b* are overlapping comes into contact with the lower side of the slide tube 24 via the engaging holes 3*b* and 4*b* as shown in FIG. 11.

With the parasol shank body 5 being prolonged, the lower portion of two facing lower engaging pats 22 which are installed at the ascending and descending member 9 and externally protrude from the ascending and descending member 9 is pushed by a finger, and the engaging shoulder 22*a* formed at the upper side of the lower engaging part 22 is separated from the facing and communicating fixing holes 24*d* and 4*f* formed at the lower sides of the slide tube 24 and the upper shank part 4. At this time, the lower portions of the two facing lower engaging parts 22 come into close contact with the lower sides of the slide tube 24 with the aid of a holding force of the finger.

In the above states, when the ascending and descending member 9 is pushed upward, the slide tube 24 made close to the lower sides of the two facing lower engaging part 22 by means of the holing force of the finger moves upward, and the engaging protrusion 7 installed in the upper inner side of the engaging shoulder 3*a* of the lower tube 3 contacting with the lower side of the slide tube 24 protrudes from the overlapping engaging holes 3*b* and 4*b*, and the upper shank part 4 and the lower shank part 3 are fixed in prolonged states. At this time, the support rib 15 rotatably engaged to the ascending and descending member 9 and the inner rib 11 rotatably engaged to the support rib 15 rotate and are unfolded, and the slide tube 24 moves upward, and the pulling piece 25 both ends of which are rotatably engaged to the top of the slide tube 24 and the support part 14 of the outer rib 12 pulls the support part 14 of the outer rib 12, and the outer rib 12 rotates, and the inner rib 11 and the outer rib 12 are unfolded like an almost straight line, and the upper side of the slide tube 24 comes into contact with the fixing member 8 and becomes a state of FIG. 12.

In this state, when the ascending and descending member 9 is continuously pushed upward, since the top of the slide tube 24 comes into contact with the fixing member 8, the ascending and descending member 9 slides and rises at the outside of the side tube 24 while overcoming the holding force of the finger, so the parasol rib assembly 10 is unfolded like the conventional parasol, and at the same time when the inner rib 11 rotates and is unfolded with the aid of the interval between the engaged portion of the inner rib 11 rotatably engaged to the fixing member 8 and the engaged portion of the pulling piece 25 rotatably engaged to the upper side of the slide tube 24, the pulling piece 25 pulls the support part 14 of the outer rib 12, and the support part 14 of the outer rib 12 comes into close contact with the inner rib 11. In a state that the ascending and descending member 9 comes into contact with the upper shoulder 24*a* of the slide tube 24 and the parasol rib assembly 10 is fully unfolded, the engaging shoulder 21*a* of the upper engaging part 21 installed at the ascending and descending member 9 is inserted into the communicating fixing holes 24*c* and 4*e* formed at the tops of the slide tube 24 and the upper shank part 4, so the parasol rib assembly 10 can be fixed in an unfolded state as shown in FIG. 13.

When a user wants to fold the parasol 1 after is it used, the parasol rib assembly 10 works in the reverse order when the parasol 1 is unfolded. In a state of FIG. 13, the upper portion of the upper engaging part 21 installed at the ascending and descending member 9 and externally protruded from the ascending and descending member 9 is pushed by a finger, and the engaging shoulder 21*a* formed at the lower side of the upper engaging part 21 inserted in the fixing holes 24*c* and 4*e* communicating with the upper sides of the slide tube 24 and the upper shank part 4 is disconnected, and the ascending and descending member 9 is pulled downward.

When the engaging shoulder 21*a* of the upper engaging part 21 is separated from the fixing holes 24*c* and 4*e*, and then ascending and descending member 9 is pulled downward, the slide tube 24 stops while coming into contact with the fixing member 8, and the ascending and descending member 9 slides downward at the outside of the slide tube 24 and comes into contact with the lower shoulder 24*b* of the slide tube 24. At this time, when the inner rib 11 rotates and is folded with the aid of the interval between the engaged portion of the inner rib 11 rotatably engaged to the fixing member 8 and the engaged portion of the pulling piece 25 rotatably engaged to the slide tube 24, the pulling piece 25 pushes the support part 14 of the outer rib 12, and the outer rib 12 rotates a little and becomes a state of FIG. 12. In the above state, when the ascending and descending member 9 is continuously pulled downward, the slide tube 24 moves downward, and the pulling piece 25 both ends of which are rotatably engaged to the top of the slide tube 24 and the support part 14 of the outer rib 12 pushes the support part 14 of the outer rib 12, so the outer rib 12 rotates and is folded.

As the ascending and descending member 9 and the slide tube 24 fully move in the downward direction of the upper shank part 4, and the parasol rib assembly 10 is fully folded, and the engaging shoulder 22*a* of two facing lower engaging parts 22 installed at the ascending and descending member 9 is inserted into the facing fixing holes 24*d* and 4*f* communicating with the slide tube 24 and the upper shank part 4 at the lower sides for thereby fixing the parasol rib assembly 10 in a folded state. At the same time, the lower side of the slide tube 24 pushes the engaging protrusion 7 which is protruded to the outside of the upper shank part 4 via the engaging holes 3*b* and 4*b*, so the lower shank part 3 becomes slidable on the upper shank part 4 as shown in FIG. 11. In this state, a user holds the folded parasol rib assembly 10 and pushes the handle 2, so it can be stored as the lower shank part 3 and the upper shank part 4 of the prolonged parasol shank body 5 are contracted as shown in FIG. 10.

The invention claimed is:

1. A parasol which includes a parasol shank body formed of a lower shank part to which a handle is engaged to its lower side, and an upper shank part which flexibly slides long the lower shank part, and engaging shoulders are formed at an upper side of the lower shank part and a lower side of the upper shank part, and engaging holes are formed above the engaging shoulders and overlap as the parasol shank body prolongs, and the parasol shank body is fixed in a prolonged state with the aid of an engaging protrusion elastically supported by means of a spring installed at an inner upper side of the engaging shoulder of the lower shank part, and a plurality of inner ribs are rotatably engaged in radial shape to a fixing member fixed at the top of the upper shank part, and the other end of each inner rib is pinned at a pin engaging part formed at an outer rib, and the outer rib is configured in such a way that the outer rib is exposed to the outside in a folded state, and at an inner end of the outer rib is formed a support part which is prolonged from a pin engaging part, and the support part can be supported on the lower side of the inner rib in an unfolded state of the outer ribs, and both ends of each of a plurality of support ribs of the parasol rib assembly are rotatably engaged in a radial shape to an ascending and descending member which ascends and descends along the intermediate portion of the inner rib and the upper shank part of the parasol shank body, comprising:

a second ascending and descending member which slides along an upper shank part at a lower side of the ascending and descending member and is inserted into the handle when the parasol shank body is contracted in a folded state of the parasol rib assembly; and an inner pulling piece and an outer pulling piece interconnected by means of ring parts are rotatably engaged to the second ascending and descending member and the support part formed at the inner side of the outer rib; and at the second ascending and descending member are installed an upper engaging part and a lower engaging part at an angle interval of 90° in a circumferential direction which are pressurized toward the upper shank part by means of an elastic force of a spring; and with an engaging shoulder being formed at its lower side, the upper engaging part is inserted into a first fixing hole formed at the top of the upper shank part of the parasol shank body in a state that the parasol rib assembly is unfolded, and with an engaging shoulder being formed at its upper side, the lower engaging part is inserted into a second fixing hole formed at a lower side of the upper shank part in a state that the parasol rib assembly is folded.

2. A parasol according to claim 1, wherein said support rib and said inner rib are formed in upside down U-shapes and are configured to face each other, and when the parasol rib assembly is folded, the inner pulling piece and the outer puling piece do not escape as the portion just below the connection portion interconnected by means of the ring parts are inserted in the support rib and the inner rib by means of facing escape prevention pins at the lower side of the engaging portion of the support rib and the inner rib for thereby enabling the outer rib to rotate.

3. A parasol according to claim 1, wherein a space part is formed at a lower side of the ascending and descending member, and in a state that the parasol rib assembly is folded, the second ascending and descending member rises and comes into contact with the lower side of the space part of the ascending and descending member, and the outer rib rotates 90° and becomes a half-unfolded state, so the outer rib of the parasol rib assembly does not contact with the hand of the user who ascends and descends the second ascending and descending member.

4. A parasol which includes a parasol shank body formed of a lower shank part to which a handle is engaged to its lower side, and an upper shank part which flexibly slides long the lower shank part, and engaging shoulders are formed at an upper side of the lower shank part and a lower side of the upper shank part, and engaging holes are formed above the engaging shoulders and overlap as the parasol shank body prolongs, and the parasol shank body is fixed in a prolonged state with the aid of an engaging protrusion elastically supported by means of a spring installed at an inner upper side of the engaging shoulder of the lower shank part, and a plurality of inner ribs are rotatably engaged in radial shape to a fixing member fixed at the top of the upper shank part, and the other end of each inner rib is pinned at a pin engaging part formed at an outer rib, and the outer rib is configured in such a way that the outer rib is exposed to the outside in a folded state, and at an inner end of the outer rib is formed a support part which is prolonged from a pin engaging part, and the support part can be supported on the lower side of the inner rib in an unfolded state of the outer ribs, and both ends of each of a plurality of support ribs of the parasol rib assembly are rotatably engaged in a radial shape to the ascending and descending member which ascends and descends along the intermediate portion of the inner rib and the upper shank part of the parasol shank body, comprising:

a tube shaped slide tube which is disposed between the upper shank part 4 and the ascending and descending member 9 and surrounds the upper shank part 4; and at the upper and lower sides of the slide tube are formed an upper shoulder for the purpose of maintaining an interval from the fixing member in a state that each ascending and descending member has risen and a lower shoulder coming into contact with the lower side of the ascending and descending member when the ascending and descending member descends; and both ends of a pulling piece are rotatably engaged to the upper side of the slide tube and the support part formed at the inner end of the outer rib; and at the ascending and descending member are disposed two lower engaging parts at an angle interval of 90° in a circumferential direction which face one upper engaging part which is pressurized toward the upper shank part with the aid of the elastic force of a spring; and the upper engaging part has an engaging shoulder at its lower end portion and is inserted into fixing holes formed at the slide tube and the upper side of the upper shank part 4 so that the parasol rib assembly can communicate in unfolded state; and two facing lower engaging parts have engaging shoulders at their upper sides and are inserted into facing fixing holes formed at the slide tube and the lower side of the upper shank part so that the parasol rib assembly can communicate in folded states.

5. A parasol according to claim 4, wherein said inner rib is formed in an upside down U-shape, and the pulling piece does not escape from the inner rib by means of the intermediate portion of the inner rib and the pin of the engaging part which is rotatably engaged to the support rib for thereby enabling the outer rib to rotate.

* * * * *